US010391462B2

(12) United States Patent
Vidakovic et al.

(10) Patent No.: US 10,391,462 B2
(45) Date of Patent: Aug. 27, 2019

(54) SAMPLE-TUBE CASSETTE AND MOUNTING PLATE FOR USE WITH HOMOGENIZING DEVICE

(71) Applicant: OMNI INTERNATIONAL, INC., Kennesaw, GA (US)

(72) Inventors: Voya Vidakovic, Marietta, GA (US); Spencer Smith, Marietta, GA (US)

(73) Assignee: Omni International, Inc., Kennesaw, GA (US)

( * ) Notice: Subject to any disclaimer, the term of this patent is extended or adjusted under 35 U.S.C. 154(b) by 820 days.

(21) Appl. No.: 14/108,962

(22) Filed: Dec. 17, 2013

(65) Prior Publication Data

US 2014/0293735 A1 Oct. 2, 2014

Related U.S. Application Data

(60) Provisional application No. 61/853,136, filed on Mar. 29, 2013.

(51) Int. Cl.
*B01F 15/00* (2006.01)
*B01F 11/00* (2006.01)

(52) U.S. Cl.
CPC .... *B01F 15/00733* (2013.01); *B01F 11/0008* (2013.01)

(58) Field of Classification Search
CPC ..... B04B 5/0414; B04B 2005/0435; B04B 5/0421; B01F 15/00662; B01F 15/00733; B01F 11/0008; B01F 9/0003
(Continued)

(56) References Cited

U.S. PATENT DOCUMENTS 3,674,198 A * 7/1972 Eberle ..... B04B 5/04 211/74
3,749,390 A 7/1973 Schubert
(Continued)

FOREIGN PATENT DOCUMENTS

DE 202004005821 9/2004
EP 1393797 3/2004

OTHER PUBLICATIONS

International Search Report for EP 14161867.8; dated Jul. 10 2014; 6 pages.

(Continued)

*Primary Examiner* — Marc C Howell
(74) *Attorney, Agent, or Firm* — Gardner Groff & Greenwald, PC

(57) ABSTRACT

A mounting apparatus for holding tubes of samples for processing by a homogenizer. The mounting apparatus includes a processing plate and at least one cassette, with the plate for mounting to the homogenizer, the cassette for mounting to the plate, and the tube for holding by the cassette. In some embodiments, the cassette includes one or more tube-retention assemblies for removably securing the tube against axial, lateral, and/or rotational movement, for example, using centrifugal forces of the homogenizer for retention assistance. In some embodiments, the cassette is removably mounted to the plate, for example, using centrifugal forces of the homogenizer for retention assistance. And in some embodiments, the tube can be replaced in the cassette with the cassette mounted to the plate adjacent an access opening through which the tube can pass, while centrifugal forces assist in retaining the tubes in the cassette during operation of the homogenizer.

20 Claims, 11 Drawing Sheets

(58) Field of Classification Search
USPC ..... 366/213, 214; 494/16, 20
See application file for complete search history.

(56) References Cited

U.S. PATENT DOCUMENTS

| | | | | |
|---|---|---|---|---|
| 4,125,335 | A | 11/1978 | Blume et al. | |
| 4,439,177 | A * | 3/1984 | Conway | B04B 5/0428 220/23.87 |
| 4,981,585 | A | 1/1991 | Kelley et al. | |
| 5,549,540 | A * | 8/1996 | Moore | B04B 5/0428 248/100 |
| 5,567,050 | A | 10/1996 | Zlobinsky et al. | |
| 6,386,749 | B1 * | 5/2002 | Watts | B01F 9/0021 211/1.53 |
| 7,101,077 | B2 | 9/2006 | Esteve et al. | |

OTHER PUBLICATIONS

Omni International. "Omni Bead Ruptor Bead Mill Homogenizers." <www.omni-inc.com>. <www.beadruptor.com>. 2 pages.

* cited by examiner

FIG. 25
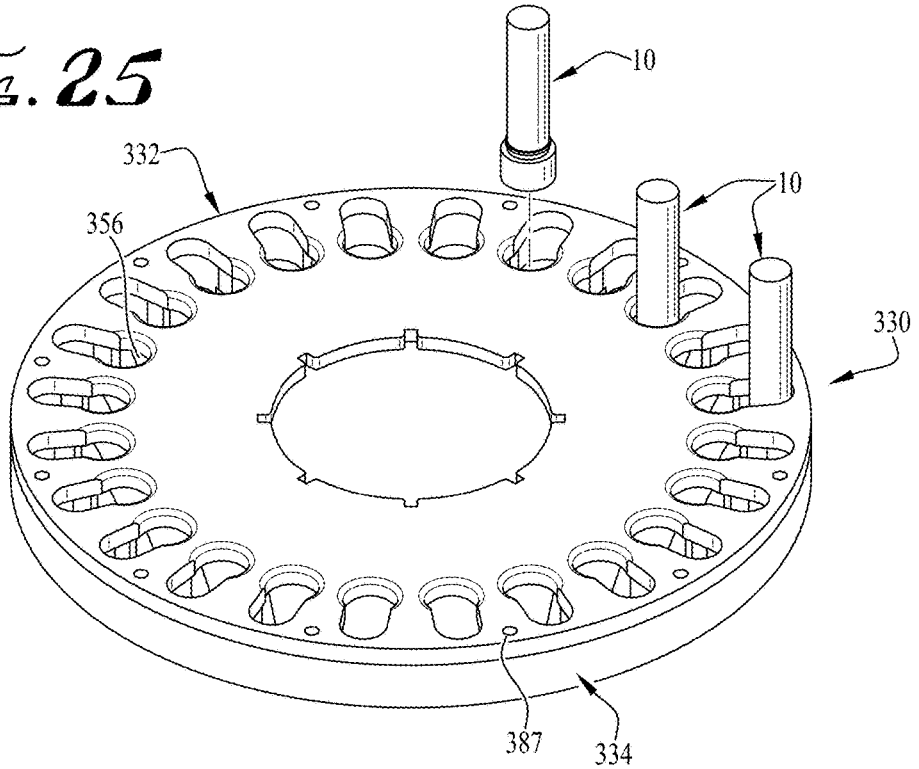
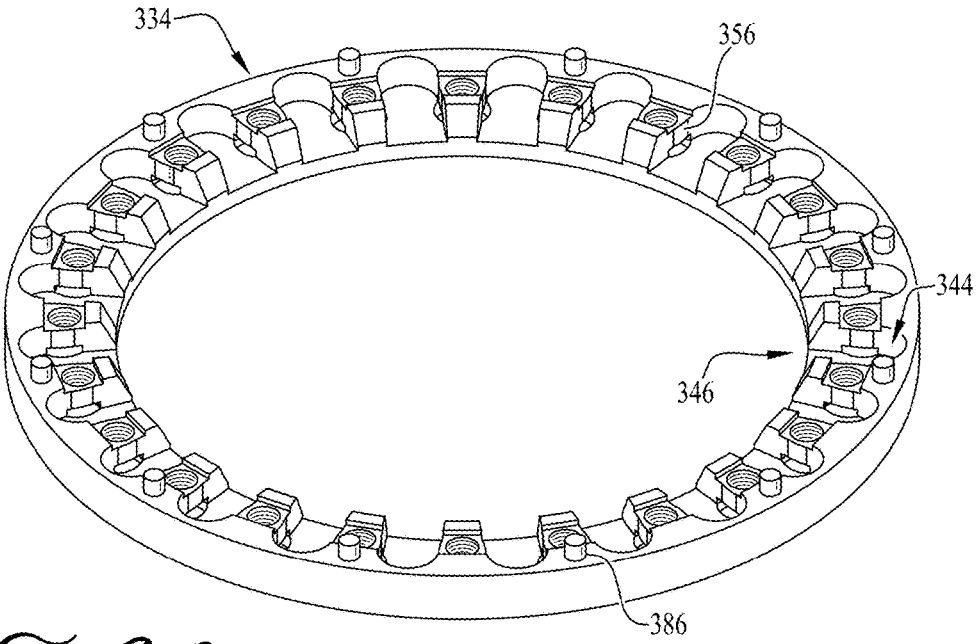
FIG. 26

SAMPLE-TUBE CASSETTE AND MOUNTING PLATE FOR USE WITH HOMOGENIZING DEVICE

CROSS-REFERENCE TO RELATED APPLICATION

This application claims the priority benefit of U.S. provisional Patent Application Ser. No. 61/853,136 filed Mar. 29, 2013, which is hereby incorporated herein by reference.

TECHNICAL FIELD

The present invention relates generally to laboratory equipment for homogenization applications, and particularly to attachments and peripherals for holding sample containers for processing by such homogenizing devices.

BACKGROUND

Homogenization involves disaggregating or emulsifying the components of a sample using a high-shear process with significant micron-level particle-size reduction of the sample components. Homogenization is commonly used for a number of laboratory applications such as creating emulsions, reducing agglomerate particles to increase reaction area, cell destruction for capture of DNA material (proteins, nucleic acids, and related small molecules), DNA and RNA amplification, and similar activities in which the sample is bodily tissue and/or tissue, or another substance. Conventional high-powered mechanical-shear homogenization devices for such applications include bead-mill and shaker-mill style homogenization devices. Some of these-type devices include a plate holding a number of tubes containing the samples and a base unit with a swash-plate that generates and transmits a "swashing" motion to the plate holder to homogenize the samples in the tubes using centrifugal forces to vigorously oscillate the tubes axially.

These bead-mill and shaker-mill devices have proven generally beneficial in accomplishing the desired homogenization of the samples. But in use they have their disadvantages. For example, in some devices the plates include axial end-clamps that secure to the tubes at their ends, thereby limiting the plates to use with only one height of tube. In some other devices, the tubes are secured in place by finger plates, which are labor- and time-intensive to use because they must be manually tightened to secure the tubes in place, and often for best results they then must be untightened, adjusted, and retightened.

Accordingly, it can be seen that needs exist for improvements in homogenization devices relating to mounting the sample tubes in place. It is to the provision of solutions to these and other problems that the present invention is primarily directed.

SUMMARY

Generally described, the present invention relates to mounting apparatus for holding tubes of samples for processing by a homogenizer. The mounting apparatus includes a processing plate and at least one cassette, with the plate for mounting to the homogenizer, the cassette for mounting to the plate, and the tube for holding by the cassette. In some embodiments, the cassette includes one or more tube-retention assemblies for removably securing the tube against axial, lateral, and/or rotational movement, for example, using centrifugal forces of the homogenizer for retention assistance. In some embodiments, the cassette is removably mounted to the plate, for example, using centrifugal forces of the homogenizer for retention assistance. And in some embodiments, the tube can be replaced in the cassette with the cassette mounted to the plate adjacent an access opening through which the tube can pass, while centrifugal forces assist in retaining the tubes in the cassette during operation of the homogenizer.

The specific techniques and structures employed by the invention to improve over the drawbacks of the prior devices and accomplish the advantages described herein will become apparent from the following detailed description of example embodiments of the invention and the appended drawings and claims.

BRIEF DESCRIPTION OF THE DRAWINGS

FIG. 25 is a top perspective view of a mounting apparatus, including a processing plate and an integral cassette ring, according to a fourth example embodiment of the invention, the processing plate for mounting to a homogenization device (not shown) and the cassette ring for holding samples to be homogenized.

FIG. 26 is a top perspective view of the cassette ring of FIG. 25.

DETAILED DESCRIPTION OF EXAMPLE EMBODIMENTS

Figure 1:
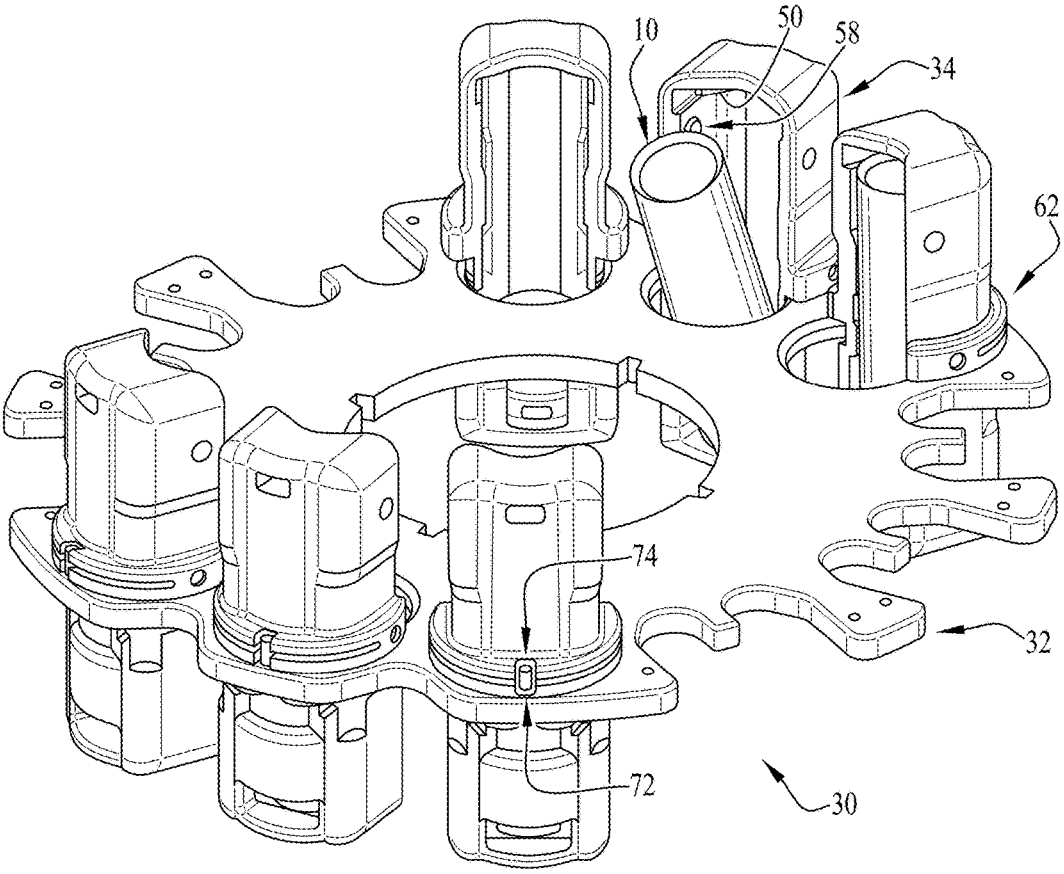
FIG. 1 is a top perspective view of a mounting apparatus, including a processing plate and a plurality of cassettes, according to a first example embodiment of the invention, the processing plate for mounting to a homogenization device (not shown) and the cassettes for holding samples to be homogenized.
Figure 14:
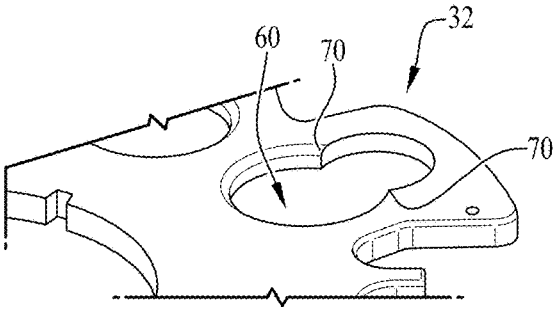
FIG. 14 is a perspective detail view of a portion of the plate of FIG. 1, showing details of communicating access and mounting openings.

The present invention relates to mounting apparatus for holding samples for processing by a homogenization device. In the depicted embodiments, the mounting apparatus are for use with high-powered bead-mill or shaker-mill homogenizer devices that generate centrifugal forces for swash-motion homogenization of the samples, or similar sample-agitation devices that use sinusoidal perturbed axial rotation to transfer force to samples in sample tubes. In other embodiments and/or applications, the mounting apparatus are for use with other types of homogenization devices that generate and impart additional or different forces and motions to the samples.

In addition, the mounting apparatus of the depicted embodiments are typically used to hold tubes containing samples of human or non-human bodily fluid and/or tissue (e.g., blood, bone-marrow cells, a coronary artery segment, or pieces of organs). In other embodiments and/or applications, the tubes hold a different substance such as other organic matter (e.g., plants or food) or other chemicals. As such, use of the term "sample" herein is intended to be broadly construed to cover any type of substance that can be homogenized and for which homogenization could be useful. Furthermore, the mounting apparatus of the depicted embodiments hold a plurality of samples. In other embodiments and/or applications, the mounting apparatus hold only a single sample.

Referring now to the drawings, FIGS. 1-20 show a tube-mounting apparatus 30 according to a first example embodiment of the invention. The mounting apparatus 30 of this embodiment includes a processing plate 32 that mounts to a homogenizer (not shown) and a plurality of cassettes 34 that each mount to the plate and hold a tube 10 containing a sample. The plate 32 and the cassettes 34 can be made of conventional materials (e.g., plastic and/or metal) using conventional fabrication techniques (e.g., molding). The dimensions referred to herein are provided only for illustration purposes and are merely representative of example embodiments, and thus are in no way limiting of the present invention (unless clearly and specifically stated otherwise).

The homogenizer that the mounting apparatus 30 is used with can be of a conventional type well-known in the art such as a bead-mill homogenizer commercially available under the BEAD RUPTOR brand from Omni International (Kennesaw, Ga.). Or the homogenizer can be of a conventional type such as those disclosed by U.S. Pat. Nos. 5,567,050 and 7,101,077, which are incorporated herein by reference. The plate 32 can mount to the homogenizer by conventional attachments that are well-known in the art, and the centrifugal forces generated by the homogenizer can be transferred to the plate (to impart the swashing motion to the cassettes 34 and thus the samples) by conventional structures that are well-known in the art. As such, details of the homogenizer are not provided herein.

The tubes 10 that the mounting apparatus 30 is used with can be of a conventional type well-known in the art such as clear, plastic, cylindrical vials with end-caps. For example, typical cylindrical tubes include those that are about 1¾ inches long with a diameter of about ⅜ inch, about 2½ inches by about ½ inch, or about 3¼ inches by about 1 inch. Thus, as used herein the term "tube" is intended to be broadly construed to cover any type of container in any shape that can hold a sample during homogenization, and as such is not limited to traditional cylindrical tubes or vials. For use with a homogenizer of a bead-mill type, the tubes 10 hold—in addition to the sample—a plurality of beads and typically also include a buffer, as is well-known in the art.

Referring particularly to FIGS. 1-13, details of the cassettes 34 and their tube-retaining features will now be described. Each of the cassettes 34 includes a body 36 that removably receives and structurally supports at least one of the tubes 10. In the depicted embodiment, the body is in the form of a generally rectangular housing with a bottom wall 38, a top wall 40, and three sidewalls 42 forming a chamber 44 that holds the tube 10, with an open front-side 46 though which the tube is inserted for use and removed after processing. The open front-side 46 also provides ventilation for dissipating heat from the samples generated during homogenization, and the body can include additional ventilation openings for this purpose. The chamber 44 is typically shaped and sized to hold a particular shape and size tube 10 with nominal extra space so that the tube can be easily inserted and removed through the open front-side 46 and removably secured in the chamber by one or more tube-retaining features.

In other embodiments, the cassette is in the form of a frame or lattice that removably receives and structurally supports the tube. In yet other embodiments, the open side of the cassette is at another portion of the body and/or forms only a portion of a side of the body. In still other embodiments, the cassette body completely encloses the tube thereby providing a sealed container that for purposes of thermal management and/or containment of fluid (gas or liquid) samples. And in still other embodiments, the cassette includes a doorway through which the tube is inserted and removed, and a door or lid that pivots, slides, rotates, or moves otherwise relative to the body between open and closed positions. As such, it will be understood that the body can be in many forms other than those disclosed herein, with many different configurations, sizes, and shapes (e.g., including generally cylindrical).

Referring particularly to FIGS. 1-2 and 4-7, the cassette 34 includes an axial-retention assembly that removably secures the tube in the chamber 44 from axial movement. In the depicted embodiment, the axial-retention assembly is provided by a ramped surface 50 that defines the top of the chamber 44 and that engages the bottom 12 (though top-positioned for homogenization) of the tube 10 upon insertion of the tube into the chamber. The ramped surface 50 is thus opposite the top/inner surface 54 of the bottom wall 38 so that they cooperatively define a varied height of the chamber 44. In this way, the height of the chamber 44 is greater at its open front-side 46 than at its rear sidewall 42, thereby permitting use of the same cassette 34 with more than one height of tube 10. For example, in some typical embodiments the ramped surface 50 has a height differential of about 1/16 inch or about 1/4 inch.

In the depicted embodiment, the axial-retention assembly includes a wedge-shaped element 48 that is positioned in the body 36 adjacent its top wall 40 and that is relatively thinner at its front than at its rear so that it forms the ramped surface 50. The wedge-shaped element 48 can be a separate piece that is attached in place by conventional fasteners such as pins, rivets, an adhesive, a friction fit, or the like (e.g., as depicted), or it can be an integrally formed portion of the cassette body 36 (i.e., the ramped surface 50 is the bottom/inner surface of the top wall).

In addition, the ramped surface 50 can include gripping elements 52 such as steps or ribs that frictionally engage and thereby grip the tube 10 (at its end 12) to help retain it in the chamber 44 from lateral movement. Furthermore, the ramped surface 50 can include tapered (e.g., curved, angled, or otherwise funneling) sidewalls 53 that can frictionally engage and thereby grip the tube 10 (at its side 18) to help retain it in the chamber 44 from lateral movement. As such, the ramped surface 50 can function as a lateral-retention and/or anti-rotation assembly, in addition to an axial-retention assembly.

In use, the axial-retention assembly enables the cassette 34 to hold a range of different-height tubes 10 and still secure them from axial movement during homogenization. For example, the wedge-shaped element 48 will engage and retain a relatively shorter tube 10*a* and a relatively taller tube 10*b* (collectively, the tubes 10), with the shorter tube received rearwardly deeper into the chamber 44 and engaging the ramped surface 50 at a location farther rearward relative to the taller tube (see FIGS. 4 and 5, respectively). Accordingly, the axes of the tubes 10 will be at slightly different angles/tilts relative to vertical, depending on their heights.

In other embodiments, the axial-retention assembly is provided in another form. For example, the axial-retention assembly can include a ramped surface defining the inner bottom surface of the chamber for engaging an axial end of the tube and partially defining the varied height of the chamber. Or the axial-retention assembly can include a top or bottom axially-positioned ramped surface that is spring-biased axially inward (downward or upward) for engaging an axial end of the tube and partially defining the varied height of the chamber. Persons of ordinary skill in the art will understand that the height differential and slope of the ramped surface can be selected as needed for providing the described axial-retention functionality.

Referring particularly to FIGS. 1-5 and 8-13, the cassette 34 also includes a lateral-retention assembly that removably secures the tube in the chamber 44 from forward lateral movement through the open front-side 46 of the body 36. In the depicted embodiment, the lateral-retention assembly is provided by the top/inner surface 54 of the bottom wall 38 including a male element 56 extending axially inward/upward into the chamber 44. The cassette 34 of this embodiment is designed for use with tubes 10 having a female element (i.e., a recess) 14 axially formed in one end. For example, many conventional tubes 10 include a top (bottom-positioned during homogenization) end-cap 16 with an axially recessed female element 14.

The male element 56 of the cassette 34 is sized and shaped to receive a range of different sized and shaped female elements 14 of tubes 10 when the tubes are positioned in the cassette for use. Thus, when used in conjunction with an axial-retention assembly, the male element 56 is typically not snugly fit into the female element 14, to allow for ease of insertion and removal of the tube 10. In typical embodiments, the male element 56 is generally cylindrical (including oblong and/or two flattened-out plan-view walls), has a height of about 3/16 inch or about 5/16 inch, has a width (side-to-side) of about 3/8 inch or about 3/4 inch, and has a depth (front-to-back) of about 1/2 inch or about 3/4 inch.

The bottom inner surface 54 (e.g., including the male element 56) cooperates with the top inner surface 50 to retain the tube 10 in the chamber 44 and prevent axial and lateral-forward movement of the tube. When used with a tube 10 having a relatively axially-shallower female element 14, the tube is supported by the transverse walls of the mating male and female elements (and is thus supported above the rest of the bottom inner surface 54). And when used with a tube 10 having a relatively axially-deeper female element 14, the tube is supported by the peripheral edge of the female element and the portion of the bottom inner surface 54 laterally outward of the male element 56. In use, the lateral-retention assembly thereby enables the cassette 34 to hold a variety of different tubes 10 with a range of different-depth and different-shape female elements 14, or even without a female element (the tube simply rests atop and is supported by the top/inner surface of the male element).

In other embodiments, the lateral-retention assembly is provided in another form. For example, the lateral-retention assembly can include a male element extending axially inward from the top inner surface of the chamber that is received in a female element axially recessed in the tube. Or the lateral-retention assembly can include a male element that is spring-biased axially inward (upward from the bottom-inner surface of the chamber and/or downward from the top inner surface) for receipt in a female element (including an end recess, the annular space peripherally surrounding an end, or the like) of the tube, with such a male element provided by for example a leaf spring, spring-biased clip, or resiliently deformable boss. In such axially spring-biased embodiments, the male element also functions as an axial-retention assembly that helps removably secure the tube from axial movement during homogenization. In still other embodiments, the male element is sized and shaped to fit snugly with and thus frictionally engage the tube, thereby also functioning as an anti-rotation assembly that helps removably secure the tube from rotational movement during homogenization.

Additional embodiments of lateral-retention assemblies are described herein and shown in FIGS. 21-22 and 25-32. Further embodiments include, for example, a gate that pivots, slides, rotates, or moves otherwise between blocking and clear positions, or a removable pin that slides through two aligned receiving holes in the sidewalls.

The cooperative functionality of the ramped surface 50 and the male element 56 is shown in FIGS. 8-13. As can be seen, the tube 10 is inserted into the cassette 34 at an angle from vertical with the end (e.g., the cap 14) having the female element 14 inserted first into engagement with the male element 56 (see FIG. 8). Then the tube 10 is pivoted/tilted (as indicated by the angular directional arrows of FIGS. 10 and 12) into the cassette chamber 44 until it is snugly held between the bottom-inner surface 54 (e.g., the male element 56 or a portion of the bottom-inner surface laterally outward of it) and the portion of the ramped top-inner surface 50 engaged by that particular height of tube (see FIG. 12).

Referring particularly to FIGS. 1-2 and 8-13, the cassette 34 also includes an anti-rotation assembly that prevents the tube 10 from rotating in the chamber 44 during operation of the homogenizer. A by-product of the motion and centrifugal forces generated by the homogenizer is the imparting of an axial rotational force on the tube 10. The anti-rotation assembly functions to substantially eliminate (i.e., reduce to a functionally negligible degree) this rotation of the tube 10 during homogenization, as is generally beneficial.

In the depicted embodiment, the anti-rotation assembly is provided by at least one spring-biased element 58. For example, a set of two aligned and opposing spring-biased elements 58 can be provided adjacent the open front-side 46 of the body 36, and more than one set can be provided (two sets are depicted). The spring-biased elements 58 resiliently deflect laterally relative to the longitudinal axis of the cassette 34 (i.e., generally radially relative to the tubes 10) between a neutral fully extended/inward position and charged fully retracted/outward position. The spring-biased elements 58 are mounted to the body 36 (e.g., on the inner surface of the sidewalls 42) adjacent the open front-side 46 (outward/forward of the plan-view center of the tube), extending laterally inward into the chamber, and resiliently deflecting/retracting outward. In typical embodiments, the spring elements 58 have a deflection range (between extended/inward and retracted/outward positions) of about 1/32 inch, with two generally aligned and opposed spring elements thus having an effective deflection range of about 1/16 inch. The nominal oversizing of the chamber 44 for the tube 10 is less than the deflection range of the spring elements 58 so that when the tube is in the chamber the spring elements are not fully extended inward and contact the tube with an inward force. The spring-biased elements 58 can be provided by commercially available spring-biased push-pins with linear-retraction pins with domed ends, as depicted.

Figure 10:
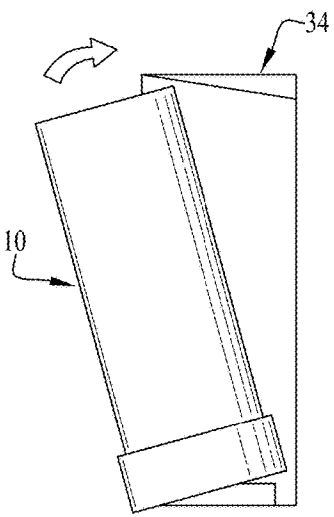
FIG. 10 shows the cassette and tube of FIG. 8 with the tube further inserted into the cassette.
Figure 8:
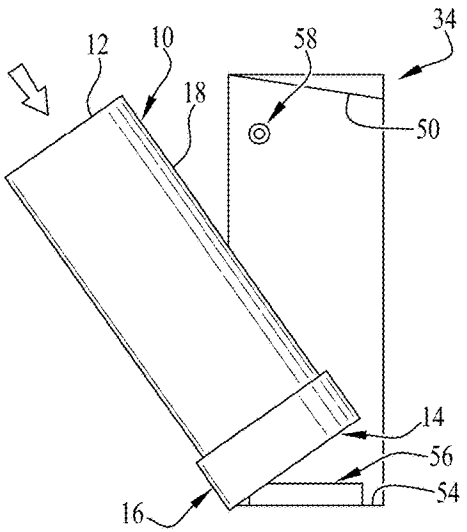
FIG. 8 is a side schematic view of the cassette and tube of FIG. 2, showing the tube beginning to be inserted into the cassette.
Figure 13:
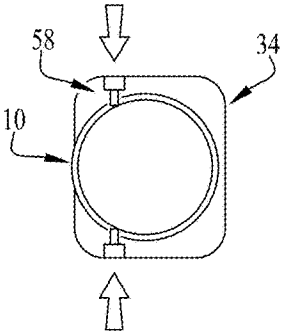
FIG. 13 is a top schematic view of the cassette and tube of FIG. 12.
Figure 11:
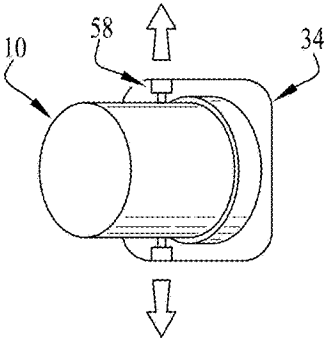
FIG. 11 is a top schematic view of the cassette and tube of FIG. 10.
Figure 9:
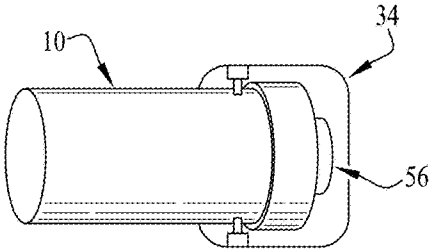
FIG. 9 is a top schematic view of the cassette and tube of FIG. 8.

In use, as the tube 10 is inserted into the chamber 44 through the open front-side 46, it contacts the spring-biased elements 58 and laterally deflects them outward (as indicated by the outward directional arrows of FIG. 11) from their neutral extended position (see FIGS. 8-9) toward their charged retracted position (see FIGS. 10-11). Once the widest part of the tube 10 has moved past the spring-biased elements 58, the spring elements resiliently return laterally inward (as indicated by the inward directional arrows of FIG. 13) back toward but not all the way to their neutral extended position. So the spring-biased elements 58 are in an intermediate charged position (see FIGS. 12-13), engaging and applying a force to the sidewall 18 of the tube 10 radially outward of the central widest portion, with this spring-force helping hold the tube in place against the rotational forces generated during homogenization. The spring-force applied is sufficiently strong that it substantially prevents rotation of the tubes 10 during homogenization but not so strong that the tubes are difficult to install and remove from the cassettes 34. And because of this spring-force, the spring-biased elements 58 also function as a lateral-retention assembly that removably secures the tube in the chamber from forward lateral movement through the open front-side 46 of the body 36.

In other embodiments, the anti-rotation assembly is provided in another form. For example, the axial-retention assembly can include other conventional spring-biased elements such as leaf springs, resiliently deformable (e.g., rubber-like) bosses, resiliently deformable (e.g., plastic) snap-fit parts, compression-spring ramps or balls, spring-biased clamps or clips, spring-biased pivot-arms, or spring-biased frictional inner-wall segments of the cassette body. In other embodiments, the cassette body has an open side (an access opening for inserting and removing the tube) positioned elsewhere and the anti-rotation assembly includes spring-biased elements positioned adjacent the other-positioned open side to provide the same functionality. And for applications in which tube rotation during homogenization is desired (or at least not needed to be prevented), the anti-rotation assembly can be eliminated or adapted to include a lock that retains the spring-biased elements in the retracted/outward position.

As described above, the spring-biased elements 58 also function as a lateral-retention assembly that helps removably secure the tube 10 in the chamber 44 from forward lateral movement through the open front-side 46 of the body 36 during homogenization. As such, some embodiments include the spring-biased elements 58 but not the male element 56 (or another lateral-retention assembly). In addition, the male element 56 can also function as an axial-retention and/or anti-rotation assembly. As such, some embodiments include the male element 56 (or another lateral-retention assembly) but not both the ramped surface 50 (or another axial-retention assembly) and the spring-biased elements 58 (or another anti-rotation assembly). Furthermore, the ramped surface 50 can also function as a lateral-retention and/or anti-rotation assembly. As such, some embodiments include the ramped surface 50 (or another axial-retention assembly) but not both the male element 56 (or another lateral-retention assembly) and the spring-biased elements 58 (or another anti-rotation assembly). Accordingly, it will be understood that all three of the disclosed tube-retention assemblies, the axial-retention assembly (e.g., with a ramped surface 30), the lateral-retention assembly (e.g., with a male element 56), and the anti-rotation assembly (with a spring-biased element 58), can each be provided individually in a cassette, in any combination with each other, or in combination with other tube-retention assemblies, as may be desirable for a given application.

In addition, the cassette body 36 and the tube-retention assemblies (particularly the anti-rotation and axial-retention assemblies) are configured so that the centrifugal forces generated by the homogenizer urge the tube 10 into, not out of, the chamber 44. In particular, the cassette body 36 is configured so that it mounts to the plate 32 with its open front-side 46 facing radially inward toward the center of the plate. So the tube-retention assemblies (e.g., the spring-biased elements 56) do not need to secure the tube 10 in the cassette chamber 44 so as to withstand the radially outward centrifugal forces, and instead these forces assist in the tube retention. In this way, the tubes 10 are easier to insert and remove from the cassette chambers 44 (less manual force and dexterity is required by the user's hands/fingers) while still secured in place during homogenization at least in part by the centrifugal forces generated.

Having described details of the cassettes 34, details of the processing plate 32 and its interrelationship with the cassettes will now be described with particular reference to FIGS. 1-2 and 14-20. The plate 32 mounts to the homogenizer by a conventional mounting mechanism not shown. Typically, the mounting mechanism provides for removable mounting so that the plate 32 can be removed and replaced for example due to maintenance, breakage/replacement, etc. The cassettes 34 are mounted to the plate 32 radially outward of the center of the plate, thereby positioning the cassettes at radially-outward extended locations to provide a moment arm and thus generate the desired homogenizing forces on the samples. Typically, the cassettes 34 mount to the plate 32 at generally peripheral locations, though not necessary at or adjacent the radially outward edge of the plate. The plate 32 can be provided by a generally flat annular disc, as depicted, or by another member (e.g., a frame or lattice) that radially extends the positions of the cassettes 34.

In the depicted embodiment, the plate 32 includes access openings 60*a* adjacent and in communication with the corresponding open sides 46 of the cassettes 34. The access openings 60*a* are configured with a shape and size providing sufficient clearance to permit the tubes 10 to be inserted into and removed from the cassette chamber 44 through the cooperating open sides 46 (via the respective access openings) while the cassettes are mounted to the plate 32. For example, a tube 10 can be tilted forward/inward through the open side 46 of its cassette 34 and into its access opening 60 of the plate 32 (see FIG. 1), then removed generally axially through that access opening. Thus, the access openings 60*a* have a radius (or other transverse dimension) $R_A$ that is greater than the radius (or other transverse dimension) $R_T$ of the tubes 10 at their largest transverse portion such as the width/diameter of their caps 16 (see FIGS. 1 and 15).

In addition, the access openings 60*a* are typically positioned radially inward of the cassettes 34, and the cassettes are oriented with the open sides 46 facing radially inward. In this way, the centrifugal forces generated by the homogenizer urge the tubes 10 against lateral/radial inward movement through the cooperating open sides 46 and access openings 60*a*, thereby providing a centrifugal-assist in locking the tubes in place during homogenizing.

Furthermore, the plate 32 and cassettes 34 typically include removable mounting features permitting the cassettes to be removed from the plate for cleaning or replacement (e.g., to install a plate configured for different cassettes or to change out a damaged one). In the depicted embodiment, an innovative removable mounting assembly includes collective openings 60 in the plate 32 and support shoulders 62 on the cassette bodies 36. The collective openings 60 each include an access opening 60*a* and a corresponding mounting opening 60*b* in communication with each other. And the support shoulder 62 can be provided by a flange (as shown), peripherally spaced tabs or pins, or at least one other form of protrusion extending radially outward from the cassette body 36.

Typically but not necessarily, an axial-retaining shoulder 64 can also be provided on the cassette body 36 and positioned (e.g., below) the support shoulder 62, as in the depicted embodiment. The axial-retaining shoulder 64 and the support shoulder 62 cooperatively form a mounting channel 66 therebetween that receives a lip portion 68 of the plate 32 that forms the mounting opening 60*b*. The axial-retaining shoulder 64 can be provided by a flange (as shown), peripherally spaced tabs or pins, a resilient element (e.g., a clip or leaf spring), or at least one other form of protrusion extending radially outward from the cassette body 36.

Figure 15:
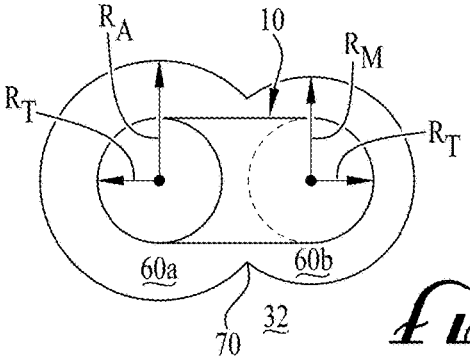
FIG. 15 is a top detail view of a portion of the plate of FIG. 14.
Figure 2:
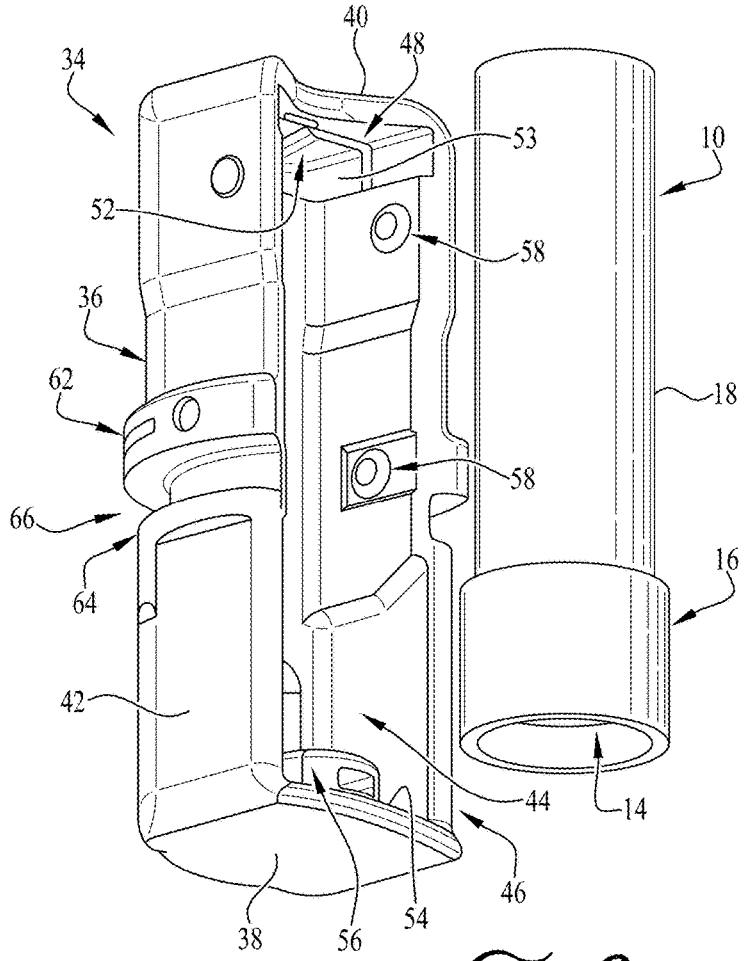
FIG. 2 is a bottom perspective view of one of the cassettes and tubes of FIG. 1, showing certain tube-retention assemblies.
Figure 3:
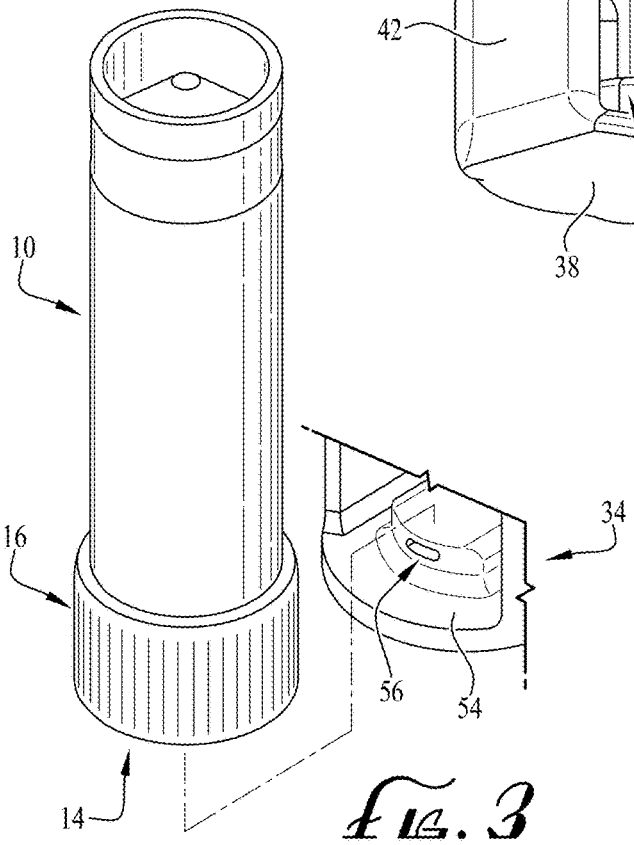
FIG. 3 is a top perspective view of a portion of the cassette and tube of FIG. 2, showing details of a lateral-retention assembly.
Figure 4:
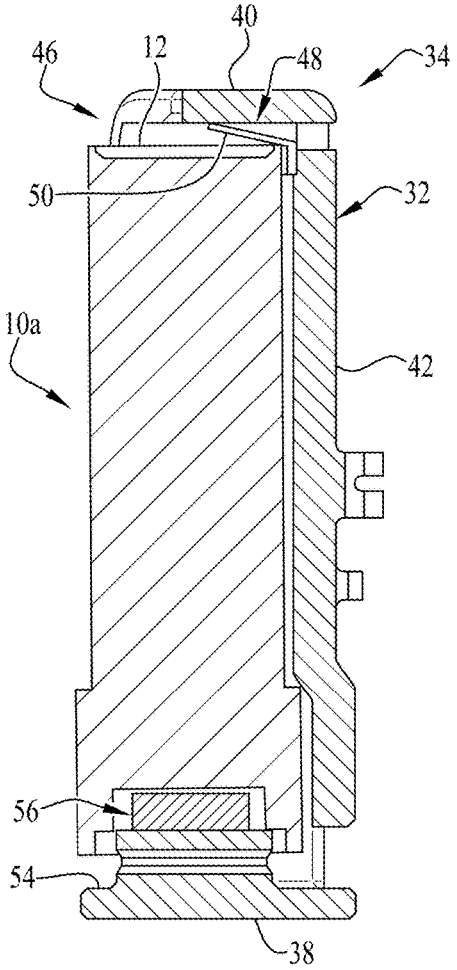
FIG. 4 is a longitudinal cross-section view of one of the cassettes and tubes of FIG. 2, showing an axial-retention assembly and a shorter tube held in the cassette.
Figure 5:
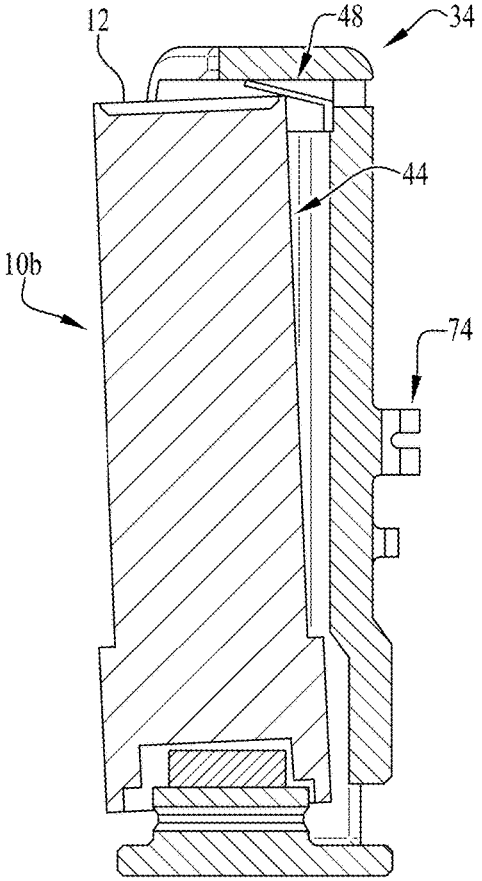
FIG. 5 shows the cassette of FIG. 4 with a taller tube held in the cassette.
Figure 6:
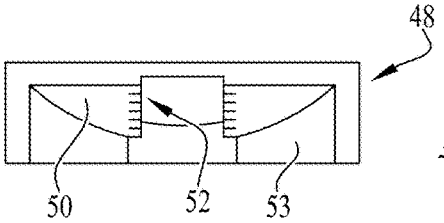
FIG. 6 is a front detail view of an axial-retention component of the cassette of FIG. 4.
Figure 7:
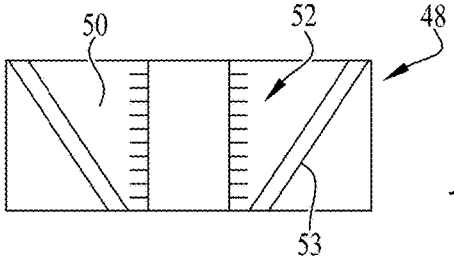
FIG. 7 is a bottom detail view of the axial-retention component of FIG. 6.
Figure 12:
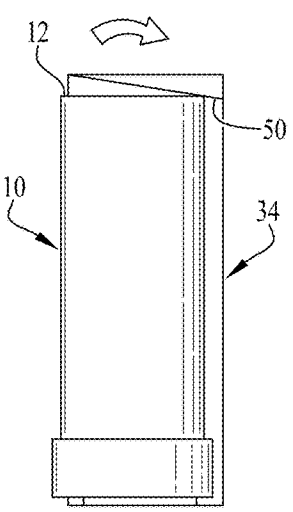
FIG. 12 shows the cassette and tube of FIG. 10 with the tube fully inserted into the cassette.
Figures 16, 17, 18, 19, 20:
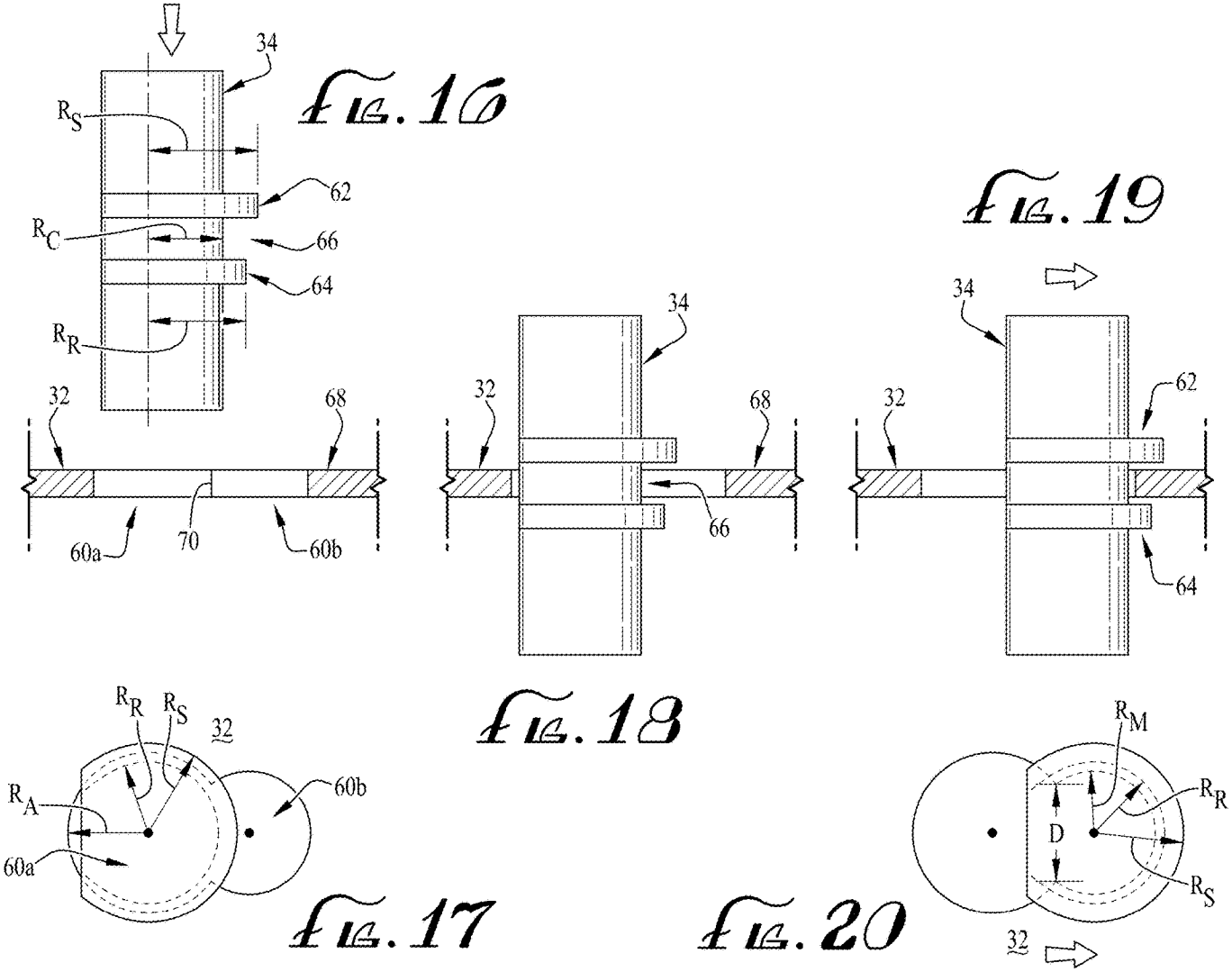
FIG. 16 is a side schematic view of the plate and cassette of FIG. 1, showing the cassette being moved toward for insertion into an access opening of the plate.
FIG. 17 is a top schematic view of the plate and cassette of FIG. 16.
FIG. 18 shows the plate and cassette of FIG. 16 with the cassette fully inserted into the access opening of the plate.
FIG. 19 shows the plate and cassette of FIG. 18 with the cassette fully inserted into the mounting opening of the plate from the access opening.
FIG. 20 is a top schematic view of the plate and cassette of FIG. 19.

The support shoulders 62 have a radius (or other transverse dimension) $R_S$ that is greater than the radius $R_A$ of the access openings 60*a*, the mounting channels 66 have a radius (or other transverse dimension) $R_C$ that is less than the access-opening radius $R_A$ and (thus also less than the support-shoulder radius $R_S$), and the retaining shoulders 64 have a radius (or other transverse dimension) $R_R$ that is less (typically only slightly less) than the access-opening radius $R_A$ (thus also less than the support-shoulder radius $R_S$) but greater than the mounting-channel radius $R_C$ (see FIGS. 15-17). And the mounting openings 60*b* have a radius (or other transverse dimension) $R_M$ that is less than the access-opening radius $R_A$, less than the support-shoulder radius $R_S$, and less than the retaining-shoulder radius $R_R$, but greater (typically only slightly) than the mounting-channel radius $R_C$ (see also FIG. 20).

In use, the cassette 34 is inserted axially downward (as indicated by the directional arrow of FIG. 16) into the access opening 60*a* (see FIGS. 16-17) until its mounting channel 66 is laterally aligned with the mounting lip 68 of the plate 32 (see FIG. 18). Then the cassette 34 is forced radially outward (as indicated by the directional arrows of FIGS. 19-20) into the smaller mounting opening 60*b*. The mounting opening 60*b* and the access opening 60*a* overlap with the two opposing intersection locations 70 spaced apart by a transverse dimension D that is less (typically only slightly) than the mounting-channel radius $R_C$ to form a constriction. And the plate 32 (at least this portion of it) is made of a deflectable material (e.g., a plastic deformable by manual forces generated in typical human installation and removal of the cassette). So the cassette 34 "snaps" into the mounting opening 60*b* and is retained there, thereby providing a snap-fit releasable lock mechanism. In other embodiments, other conventional releasable lock mechanisms can be provided. The tubes 10 can be removed after homogenization by reversing this process.

In addition, the access openings 60*a* are typically positioned radially inward of the mounting openings 60*b*. In this way, the centrifugal forces generated by the homogenizer urge the cassettes 34 against lateral/radial inward movement back into the access openings 60*a*, thereby providing a centrifugal-assist in locking the cassettes in place during homogenizing.

Furthermore, to orient the cassettes 34 in the mounting openings 60*b* with their open sides 46 facing radially inward, the plate 32 and the cassettes can include keyed elements. In the depicted embodiment, for example, the plate 32 includes at least one protrusion (e.g., a pin or rib) 72 adjacent each mounting opening 60*b* and the cassette bodies 36 each include at least one recess (e.g., a notch or channel) 74 in the support shoulder 62 that receives the protrusion only when the cassette 34 is properly oriented (see FIGS. 1 and 5). In other embodiments, the keyed elements are reversed (the protrusion is on the cassette and the recess is in the plate), the key elements on the cassettes are formed in another portion of the cassettes (e.g., the retaining shoulder or mounting channel), and/or other conventional forms of keyed elements are provided.

In other embodiments, the plate does not include the access openings (so the tubes cannot be removed while the cassettes are mounted to the plate), or they are included but not positioned radially inward of the cassette open sides (in applications where centrifugal forces are no or less of an issue), as may be desired in given applications. In yet other embodiments, the plate does not include the mounting openings (the cassettes are not removable or they are removable by another mounting mechanism), or they are included but not positioned radially inward of the cassette open sides (in applications where centrifugal forces are no or less of an issue), as may be desired in given applications. In other embodiments, the plate and cassette are adapted for bottom insertion and removal of the cassettes. In still other embodiments, the plate and the cassette include conventional removable or permanent mounting structures known in the art. And in yet still other embodiments, the mounting apparatus 30 includes one or more of the tube-retention assemblies but not the removable-mounting assembly, and vice versa.

Figure 21:
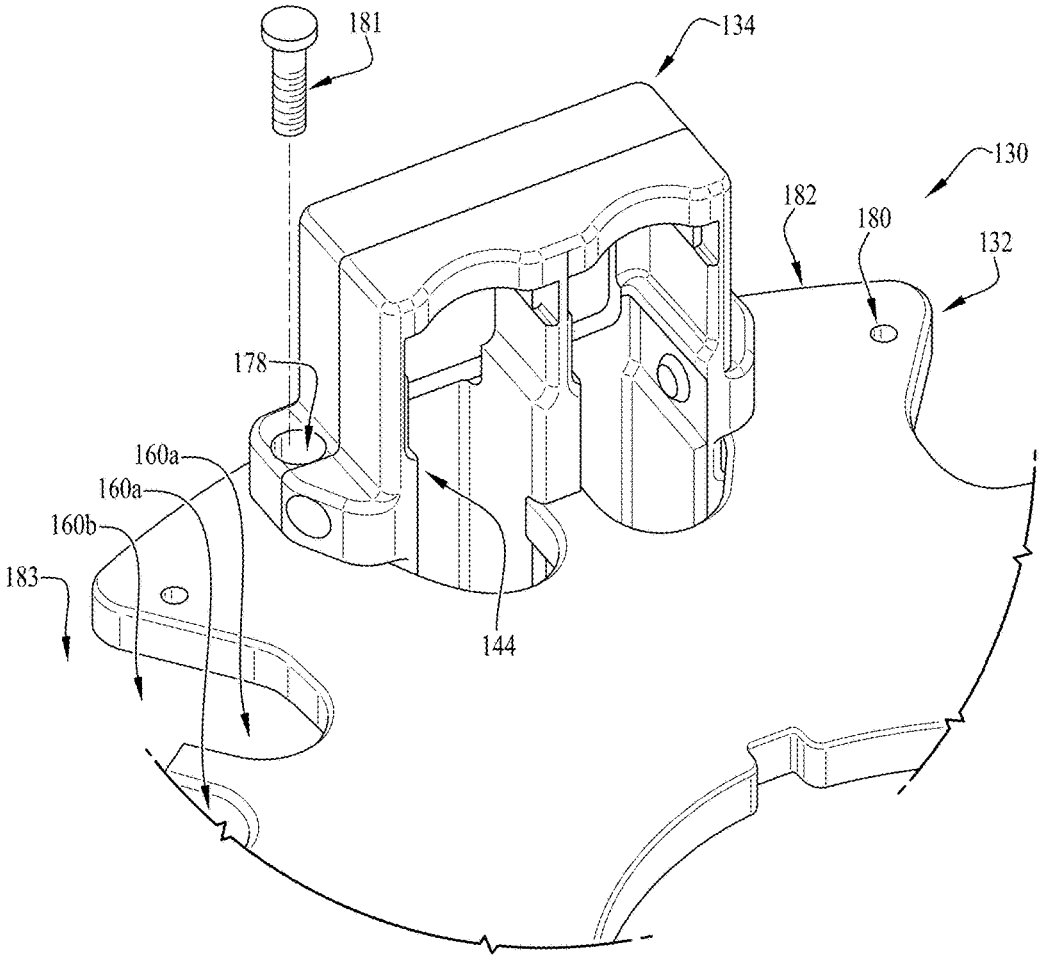
FIG. 21 is a top perspective view of a portion of a mounting apparatus, including a processing plate and a plurality of cassettes, according to a second example embodiment of the invention, the processing plate for mounting to a homogenization device (not shown) and the cassettes for holding samples to be homogenized.
Figure 22:
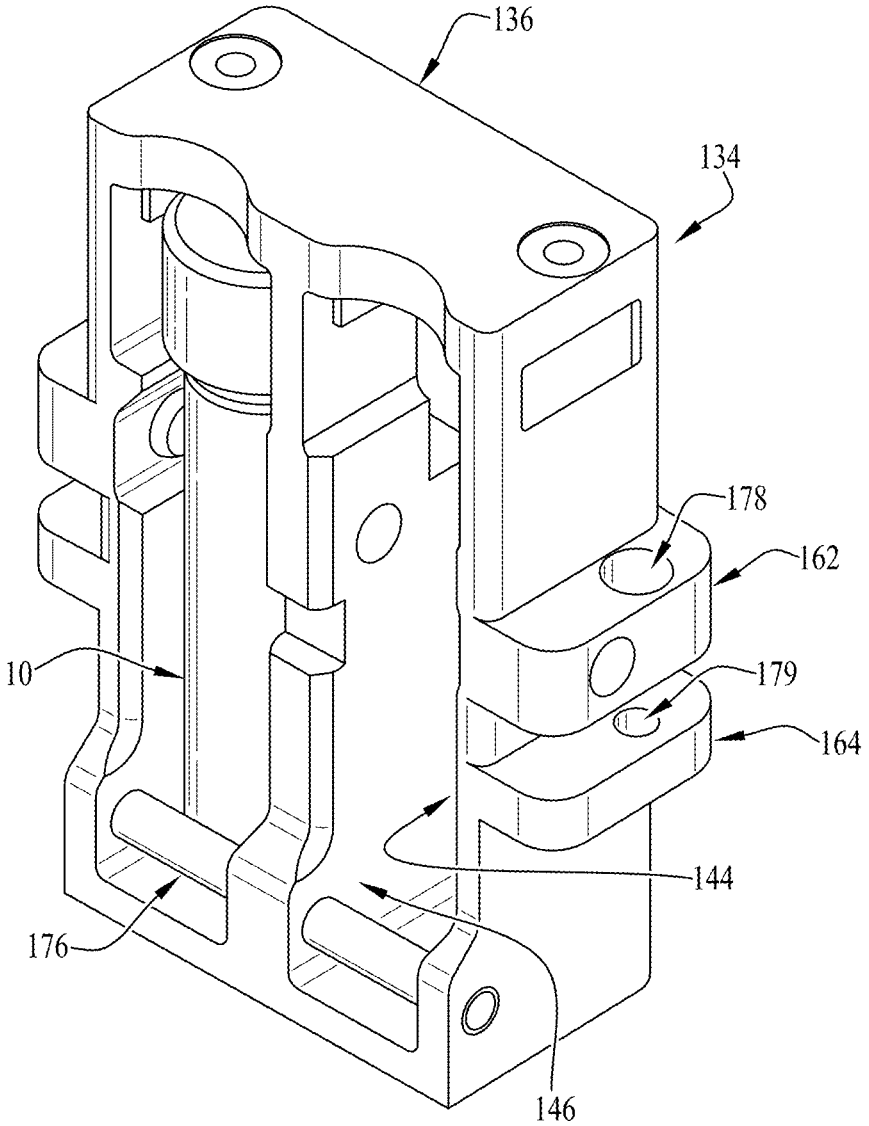
FIG. 22 is a top perspective view of the cassette and tube of FIG. 21.

FIGS. 21-22 show a portion of a mounting apparatus 130 according to a second example embodiment of the invention. The mounting apparatus 130 of this embodiment is similar to that of the first example embodiment, so only some notable differences will be described. In one aspect, the mounting apparatus 130 includes cassettes 134 with two chambers 144 each holding one tube 10. In this way, each cassette 134 can hold two tubes 10 at once. Other embodiments include more than two chambers for holding more than two tubes at once. As such, the cassettes 134 provide for higher-volume sample processing.

In another aspect, the mounting apparatus 130 includes cassettes 134 with a different tube-retention assembly, in particular a different lateral-retention assembly. A transverse member (e.g., a rod, bar, or panel) 176 extends across the open side 146 of the cassette body 136, typically adjacent the top or bottom of the open side, to removably secure the tube 10 in the chamber 144 from lateral movement during homogenization. The transverse member 176 typically extends all the way across the open side 146 and is attached to opposing sidewalls of the cassette body 136, though in some embodiments they extend only partially across sufficiently to provide the lateral-retention functionality. Also, in this embodiment the tubes 10 can be installed cap-up (as depicted) or cap-down.

And in another aspect, the mounting apparatus 130 includes a different removable-mounting assembly that removably mounts the cassettes 134 to the plate 132. For example, the mounting openings **160*b* are typically sized larger for receiving the larger dual-tube cassettes 134. And two access openings 160*a* are typically provided in communication with each mounting opening 160*b*, each access opening positioned radially inward and in communication with the portion of the mounting opening where the respective cassette chamber 144** is positioned.

In this embodiment, the mounting openings **160*b* are provided by notches formed in the peripheral edge 182 of the plate 134 and recessed radially inward therefrom. As such, the cassettes 134 are installed and removed by sliding them radially inward and outward, respectively, through the open outer ends 183 of the mounting openings 160*b*. Accordingly, the access openings 160*a* are configured only for installing and removing the tubes 10, and need not be sized larger or otherwise configured for also installing and removing the larger cassettes 134** that hold the tubes. As such, this embodiment is well-suited for use with homogenizers regardless of centrifugal or other forces being generated during homogenizing.

In addition, the support and retaining shoulders 162 and 164 include aligned axial lock openings 178 and 179 that align with an axial lock opening 180 in the plate 134 when the cassette 134 is properly mounted in place. The three aligned lock openings 178-180 removably receive a lock pin 181 to form a releasable lock mechanism that secures the cassette 134 to the plate 132 during homogenization. In other embodiments, the cassettes can be held in place by snap-fit or other conventional releasable lock mechanisms.

Figure 23:
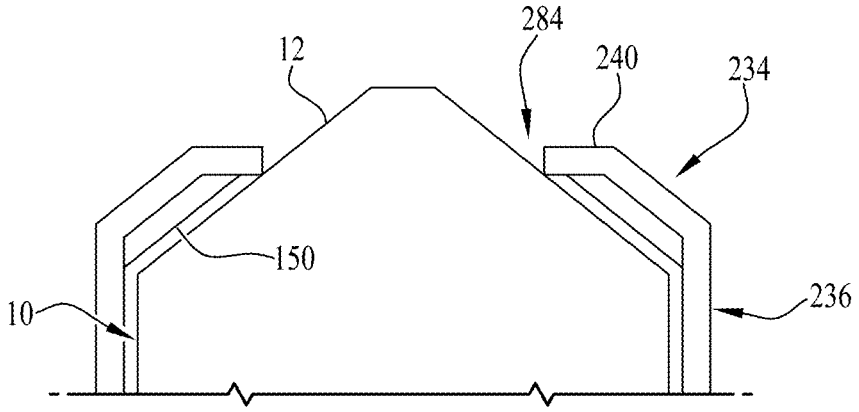
FIG. 23 is a side detail view of a portion of a cassette of a mounting apparatus according to a third example embodiment of the invention, the cassette for holding a sample to be homogenized.
Figure 24:
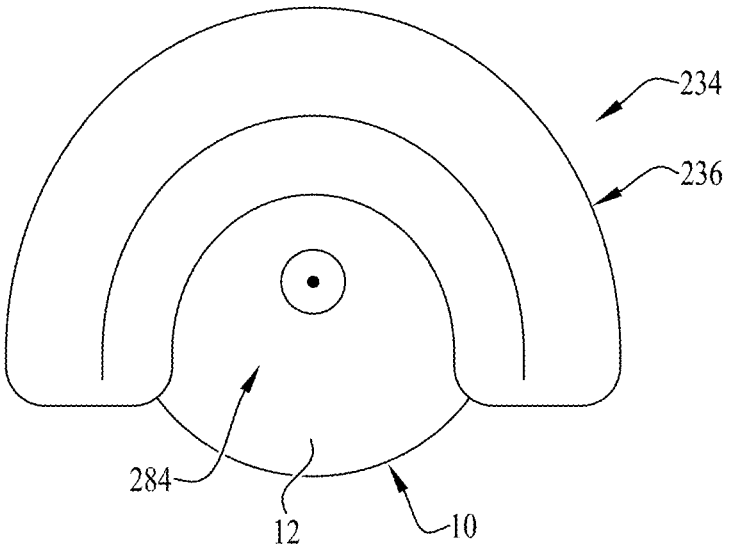
FIG. 24 is a top view of the cassette and tube of FIG. 23.
Figure 27:
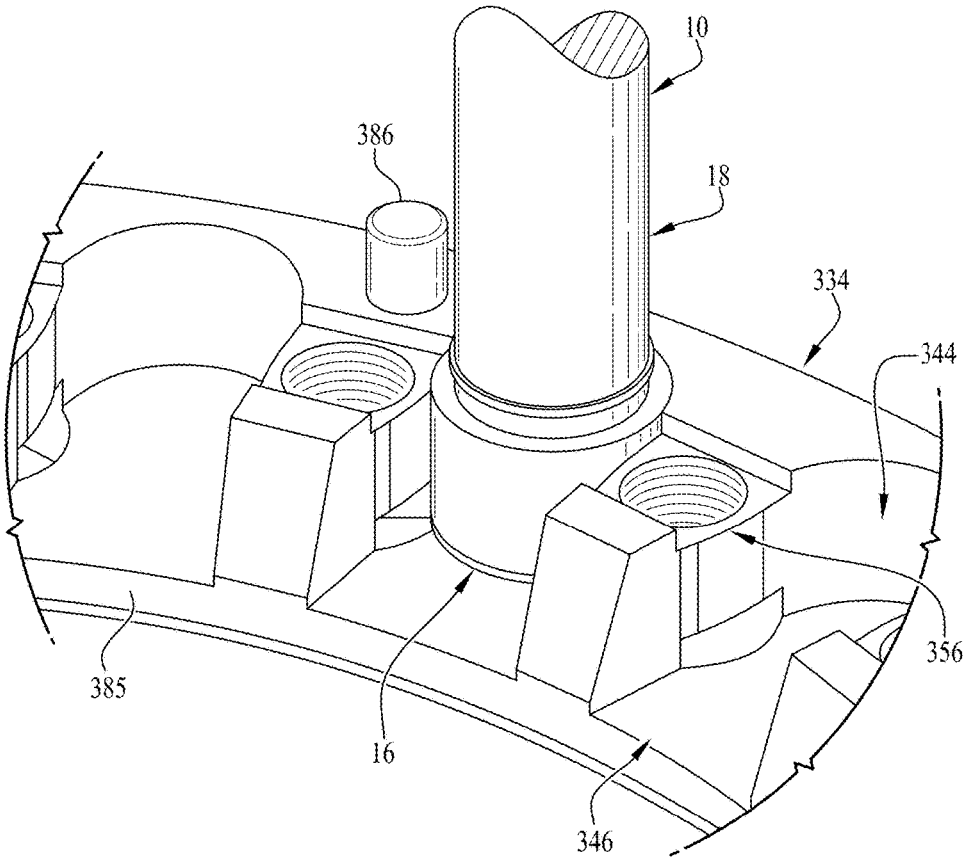
FIG. 27 is a detail view of a portion of the cassette ring of FIG. 26 shown holding one of the tubes.
Figure 31:
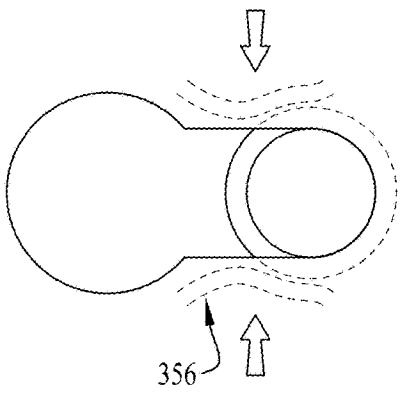
FIG. 31 shows the plate, cassette ring, and tube of FIG. 28 with the tube fully inserted into the mounting opening and chamber.
Figure 30:
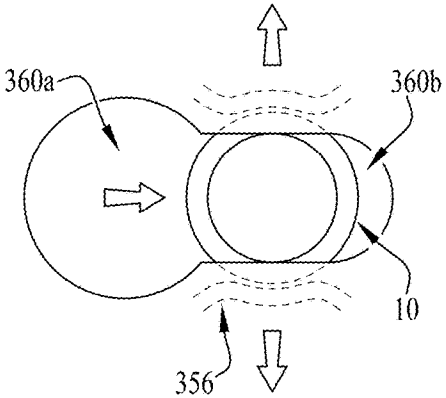
FIG. 30 shows the plate, cassette ring, and tube of FIG. 28 with the tube being inserted into a mounting opening of the plate and a corresponding chamber of the cassette ring.

FIGS. 23-24 show a cassette 234 of a mounting apparatus according to a third example embodiment of the invention. The cassette 234 of this embodiment is similar to that of the first example embodiment, so only some notable differences will be described. In one aspect, the body 236 of each cassette 234 includes an opening (e.g., a notch) 284 extending axially through its top wall 240 (including its ramped surface 250). In this way, the cassette 234 can hold a tube 10 with a conical or otherwise tapered bottom (top-positioned during homogenization) 12.

FIGS. 25-32 show a mounting apparatus 330 according to a fourth example embodiment of the invention. The mounting apparatus 330 of this embodiment is similar to that of the first example embodiment, but with some significant differences. In one aspect, the processing plate 332 is adapted to include an integral cassette ring 334 having at least one tube-retention assembly for each tube 10 thereby enabling the tubes 10 to be removably mounted directly to the plate (effectively eliminating the need for the separate removable cassettes of the type detailed in the previously described embodiments). The processing plate 332 and the cassette ring 334 can be made as two parts that are permanently attached together for example by keyed pins 386 and holes 387.

In the depicted embodiment, the plate 332 includes the access openings **360*a* and the mounting openings 360*b*. But instead of being sized and shaped relative to shoulders of cassettes, they are sized and shaped relative to the tubes 10 themselves. Thus, each access opening 360*a* is sized to axially receive the tube body 18 and the radially-larger tube endcap 16 (and a tube flange 15 adjacent the endcap), while each corresponding mounting opening 360*b* is sized to axially receive the tube body but not the radially-larger endcap and flange (see FIGS. 28-29). As such, the tube sidewall/body 18** (or at least the majority thereof) is exposed to forced convection to facilitate cooling of the samples in the tubes.

In addition, the tube-retention cassette ring 334 includes a support plate 385 defining a plurality of chambers 344 each sized and shaped to receive one of the tubes 10 by its endcap 16, each having an open side 346 through which the respective tube 10 can slidingly pass, and each positioned under and axially aligned with a corresponding one of the mounting openings **360*b*. And the cassette ring 334 includes at least one tube-retention assembly that removably secures the tubes 10 in their respective chambers 344. In typical embodiments such as that depicted, each tube-retention assembly is a lateral-retention assembly including at least one spring-biased element 356** that resiliently deflects between a neutral radially inward extended position and a charged radially outward retracted position. In other embodiments, the spring-biased elements can be provided by other conventional retention structures known in the art and/or by other tube-retention assembly components described with respect to the other embodiments disclosed herein.

Figure 28:
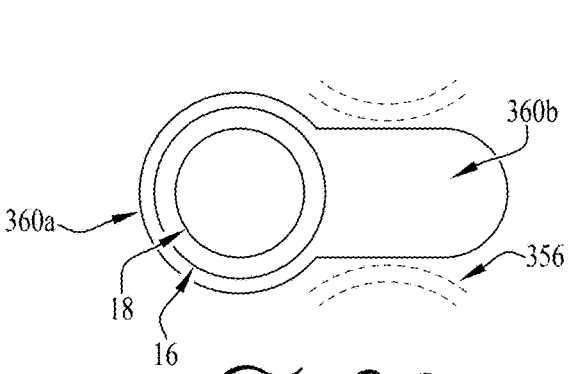
FIG. 28 is a side schematic view of the plate and cassette ring of FIG. 25, showing one of the tubes inserted into an access opening of the plate.
Figure 32:
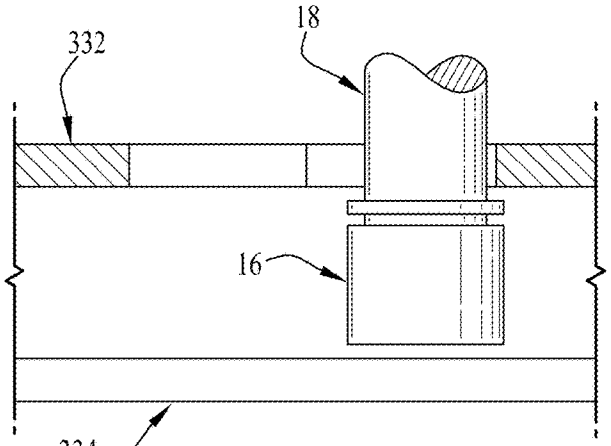
FIG. 32 is a top schematic view of the plate, cassette ring, and tube of FIG. 31.
Figure 29:
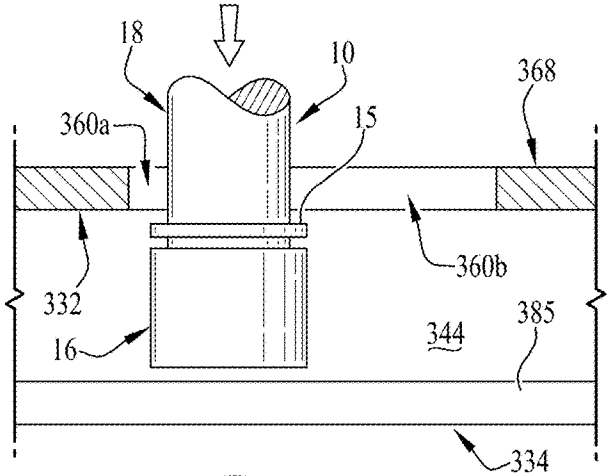
FIG. 29 is a top schematic view of the plate, cassette ring, and tube of FIG. 28.

In use, each tube 10 is oriented with its endcap 16 down, axially aligned with one of the access openings 360*a*, and moved axially downward (as indicated by the directional arrow of FIG. 29) until the endcap and flange 15 have cleared the plate 332 and radially/laterally aligned with the corresponding chamber 344 (see FIGS. 28-29). Then the tube 10 is moved laterally/radially outward (as indicated by the rightward directional arrow of FIG. 30) until the endcap 16 (its curved sidewall) engages and deflects (as indicated by the opposing directional arrows of FIG. 30) the spring-biased elements 356 from their neutral extended positions (see FIG. 28) to their charged extended positions (see FIG. 30). When the tube 10 has reached the secured position (see FIGS. 31-32) in the chamber 344, the spring-biased elements 356 resiliently deflect back inward (as indicated by the opposing directional arrows of FIG. 31) to intermediate charged positions engaging and applying spring forces on the endcaps 16 to retain the tubes 10 in place for homogenization. In this position, the tube 10 cannot be axially withdrawn from the mounting opening because the flange 15 is retained by the lip portion 368 of the processing plate 332. The tubes 10 can be removed after homogenization by reversing this process. This embodiment is well-suited for use with tubes 10 having an integral flange 15 adjacent the endcap 16 for retention by the processing plate 332, as retention by the endcap itself would tend to force the endcap off during operation.

Accordingly, the various embodiments of the invention provide various advantages over known tube-mounting apparatus for homogenizers. Advantages include using centrifugal forces generated by a homogenizer to process samples in tubes, and using the same centrifugal forces to secure the tubes in cassettes (even tubes of varied dimensions) and also secure the cassettes to a processing plate. In addition, the tubes can still be easily removed from the cassettes and the cassettes easily removed from the plate when the homogenizer is not in operation, as needed. Further, the tubes can be easily removed from the cassettes, without first removing the cassettes from the plate.

It is to be understood that this invention is not limited to the specific devices, methods, conditions, or parameters described and/or shown herein, and that the terminology used herein is for the purpose of describing particular embodiments by way of example only. Thus, the terminology is intended to be broadly construed and is not intended to be limiting of the claimed invention. For example, as used in the specification including the appended claims, the singular forms "a," "an," and "one" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

While the invention has been shown and described in exemplary forms, it will be apparent to those skilled in the art that many modifications, additions, and deletions can be made therein without departing from the spirit and scope of the invention as defined by the following claims.

What is claimed is:

1. A mounting apparatus for holding at least one tube of a sample for processing by a homogenizer, the mounting apparatus comprising:

a processing plate adapted to mount to the homogenizer, the processing plate defining an access opening extending axially all the way through the plate and through which at least a portion of the tube can pass axially relative to itself and the plate; and at least one cassette mounted to the plate, wherein the cassette includes a body defining at least one chamber that removably receives the tube during use of the homogenizer and defining an open side through which the tube can pass sideways during insertion and removal relative to the chamber, wherein the open side of the cassette is in communication with the access opening of the plate so that the tube can be inserted into the cassette while the cassette is mounted to the plate by being moved axially, with respect to itself and the plate, into the access opening of the plate and then moved sideways and radially, with respect to the plate, into the chamber of the cassette until the tube is in a use position generally perpendicular to and extending axially all the way through the plate, wherein the access opening of the plate is positioned radially inward, with respect to the plate, of the open side of the cassette so that centrifugal forces urge the tube into the cassette chamber during operation of the homogenizer, wherein the cassette body is positioned on the plate radially outward of the access opening so that the access opening is free of the cassette body such that the tube is movable axially into the access opening but not into the cassette chamber and then radially outward out of the access opening and into the cassette chamber for use during operation of the homogenizer, and wherein the cassette body includes a top and bottom that secure the received tube from axial movement during operation of the homogenizer.

2. The mounting apparatus of claim 1, wherein the cassette is mounted to the plate removably, the plate includes a mounting opening through which the cassette axially extends when mounted to the plate, and the access opening and the mounting opening are in communication.

3. The mounting apparatus of claim 2, wherein the access opening is positioned radially inward of the mounting opening so that centrifugal forces urge the cassette into the mounting opening during operation of the homogenizer.

4. The mounting apparatus of claim 2, further comprising keyed elements on the cassette and the plate that mate with each other to orient the cassette with the open side facing radially inward so that centrifugal forces urge the tube into the cassette chamber during operation of the homogenizer.

5. The mounting apparatus of claim 2, wherein the access opening is larger than the mounting opening such that a first portion of the cassette cannot be inserted or removed axially through the access opening or the mounting opening and such that a second portion of the cassette can be inserted and removed axially through the access opening but not the mounting opening, and wherein the access opening and the mounting opening are configured such that the cassette is movable axially into the access opening and then radially outward out of the access opening and into the mounting opening, to mount the cassette to the plate in the plate mounting opening but not in the plate access opening for use during operation of the homogenizer.

6. The mounting apparatus of claim 5, wherein the first portion of the cassette includes a support shoulder extending radially outward from the cassette body and the second portion of the cassette includes a retaining shoulder extending radially outward from the cassette body and spaced axially apart from the support shoulder.

7. The mounting apparatus of claim 5, wherein when positioned in the mounting opening the cassette is in a releasably locked position in which a mounting channel formed between the support and retaining shoulders receives a lip portion of the plate.

8. The mounting apparatus of claim 5, wherein the access opening and the mounting opening overlap at intersection locations that are spaced apart by a smaller dimension than a width of the cassette to form a constriction but that are resiliently deflectable when the cassette is forced through the constriction to form a snap-fit releasable lock that couples the cassette to the plate.

9. The mounting apparatus of claim 2, wherein the mounting opening is a notch formed in a peripheral edge of the plate, and further comprising a lock mechanism adapted to releasably lock the cassette to the plate with the cassette in the mounting opening.

10. The mounting apparatus of claim 9, wherein the lock mechanism includes at least one lock opening of the plate and at least one lock opening of the cassette body that aligns with the plate lock opening to receive therethrough a lock pin.

11. The mounting apparatus of claim 9, wherein the cassette includes at least one tube-retention assembly that removably secures the tube in the cassette chamber during operation of the homogenizer.

12. A mounting apparatus for holding at least one tube of a sample for processing by a homogenizer, the mounting apparatus comprising:

a processing plate adapted to mount to the homogenizer, the processing plate defining an access opening extending axially all the way through the plate and through which at least a portion of the tube can pass axially relative to itself and the plate; and at least one cassette mounted to the plate, wherein the cassette includes a body defining at least one chamber that removably receives the tube during use of the homogenizer and defining an open side through which the tube can pass sideways during insertion and removal relative to the chamber, wherein the open side of the cassette is in communication with the access opening of the plate so that the tube can be inserted into the cassette while the cassette is mounted to the plate by being moved axially, with respect to itself and the plate, into the access opening of the plate and then moved sideways and radially, with respect to the plate, into the chamber of the cassette until the tube is in a use position generally perpendicular to and extending axially all the way through the plate, wherein the access opening of the plate is positioned radially inward, with respect to the plate, of the open side of the cassette so that centrifugal forces urge the tube into the cassette chamber during operation of the homogenizer, wherein the mounting opening is a notch formed in a peripheral edge of the plate, and wherein the cassette is in the form of a ring permanently mounted to and below the plate with the mounting opening of the plate axially aligned with the chamber of the cassette ring.

13. A mounting apparatus for holding at least one tube of a sample for processing by a homogenizer, the mounting apparatus comprising:

a processing plate adapted to mount to the homogenizer, the processing plate defining an access opening extending axially all the way through the plate and through which at least a portion of the tube can pass axially relative to itself and the plate; and at least one cassette mounted to the plate, wherein the cassette includes a body defining at least one chamber that removably receives the tube during use of the homogenizer and defining an open side through which the tube can pass sideways during insertion and removal relative to the chamber, wherein the open side of the cassette is in communication with the access opening of the plate so that the tube can be inserted into the cassette while the cassette is mounted to the plate by being moved axially, with respect to itself and the plate, into the access opening of the plate and then moved sideways and radially, with respect to the plate, into the chamber of the cassette until the tube is in a use position generally perpendicular to and extending axially all the way through the plate, wherein the access opening of the plate is positioned radially inward, with respect to the plate, of the open side of the cassette so that centrifugal forces urge the tube into the cassette chamber during operation of the homogenizer, wherein the cassette is mounted to the plate removably, the plate includes a mounting opening through which the cassette axially extends when mounted to the plate, and the access opening and the mounting opening are in communication, wherein the access opening is larger than the mounting opening such that a first portion of the cassette cannot be inserted or removed axially through the access opening or the mounting opening and such that a second portion of the cassette can be inserted and removed axially through the access opening but not the mounting opening, wherein the access opening and the mounting opening are configured such that the cassette is movable axially into the access opening and then radially outward out of the access opening and into the mounting opening, so the cassette is mounted to the plate in the plate mounting opening and not in the plate access opening for use during operation of the homogenizer, and wherein the access opening is positioned radially inward of the mounting opening so that centrifugal forces urge the cassette into the mounting opening during operation of the homogenizer.

14. The mounting apparatus of claim 13, wherein:

the cassette first portion includes a support shoulder extending radially outward from the cassette body and the cassette second portion includes a retaining shoulder extending radially outward from the cassette body and spaced axially apart from the support shoulder, the access opening is larger than the mounting opening such that the support shoulder of the cassette cannot be inserted or removed axially through the access opening or the mounting opening and such that the retaining shoulder of the cassette can be inserted and removed axially through the access opening but not the mounting opening, the cassette is movable radially outward from the access opening to the mounting opening to a releasably locked position in which a mounting channel formed between the support and retaining shoulders receives a lip portion of the plate, and the access opening and the mounting opening overlap at intersection locations that are spaced apart by a smaller dimension than a width of the cassette to form a constriction but that are resiliently deflectable when the cassette is forced through the constriction to form a snap-fit releasable lock that couples the cassette to the plate.

15. A cassette for holding at least one tube of a sample for processing by a homogenizer, the cassette removably mounted to a plate that removably mounts to the homogenizer, the cassette comprising:

a body defining at least one chamber that removably receives the tube during use of the homogenizer and defining an open side through which the tube can pass sideways during insertion and removal relative to the chamber, wherein the cassette body restrains the tube from axial movement when the tube is held in the cassette chamber; and at least one tube-retention assembly that removably secures the tube in the cassette chamber during operation of the homogenizer, wherein the cassette mounts to the plate with the open side of the cassette in communication with an access opening of the plate extending axially all the way through the plate and through which at least a portion of the tube can pass axially with respect to itself and the plate so that the tube can be inserted into the cassette while the cassette is mounted to the plate by being moved axially, with respect to itself and the plate, into the access opening of the plate and then moved sideways and radially, with respect to the plate, into the chamber of the cassette until the tube is in a use position generally perpendicular to and extending axially all the way through the plate, and wherein the cassette mounts to the plate with the open side of the cassette positioned radially outward, with respect to the plate, of the access opening of the plate so that centrifugal forces urge the tube into the cassette chamber during operation of the homogenizer.

16. The tube-holding cassette of claim 15, wherein the at least one chamber of the cassette includes two chambers.

17. The tube-holding cassette of claim 15, wherein the cassette body includes a top wall defining an opening therethrough that removably receives a portion of the tube.

18. The tube-holding cassette of claim 15, wherein the cassette mounts to the plate with the open side of the cassette facing radially inward, relative to the plate, so that the cassette open side is in communication with the access opening of the plate.

19. A cassette for holding at least one tube of a sample for processing by a homogenizer, the cassette removably mounted to a plate that removably mounts to the homogenizer, the plate including a mounting opening through which the cassette extends axially with respect to the plate when mounted to the plate, the cassette comprising:

a body defining at least one chamber that removably receives the tube during use of the homogenizer and defining an open side through which the tube can pass during insertion and removal relative to the chamber; and at least one tube-retention assembly that removably secures the tube in the cassette chamber during operation of the homogenizer, wherein the access opening and the mounting opening are in communication, the access opening is positioned radially inward, with respect to the plate, of the mounting opening so that centrifugal forces urge the cassette into the mounting opening during operation of the homogenizer, and the access opening is larger than the mounting opening, the cassette includes a support shoulder extending radially outward from the cassette body and a retaining shoulder extending radially outward from the cassette body and spaced axially apart from the support shoulder, wherein the support shoulder cannot be inserted or removed axially through the access opening or the mounting opening, and the retaining shoulder can be inserted and removed axially through the access opening but not the mounting opening, and the cassette is movable radially outward from the access opening to the mounting opening to a releasably locked position in which a mounting channel formed between the support and retaining shoulders receives a lip portion of the plate.

20. A cassette for holding at least one tube of a sample for processing by a homogenizer, the cassette removably mounted to a plate that removably mounts to the homogenizer, the cassette comprising:

a body defining at least one chamber that removably receives the tube during use of the homogenizer and defining an open side through which the tube can pass during insertion and removal relative to the chamber; and at least one tube-retention assembly that removably secures the tube in the cassette chamber during operation of the homogenizer, wherein the tube-retention assembly includes an axial-retention assembly including a ramped surface that removably secures the tube in the chamber against axial movement during operation of the homogenizer, a lateral-retention assembly including a male element or a transverse element that removably secures the tube in the chamber against lateral movement during operation of the homogenizer, an anti-rotation assembly including a spring-biased element that removably secures the tube in the chamber against rotational movement during operation of the homogenizer, or a combination thereof.

* * * * *